United States Patent [19]

Hiya et al.

[11] 4,326,908

[45] Apr. 27, 1982

[54] PROCESS OF PRODUCING ROLL-SHAPED MAGNET

[75] Inventors: Koji Hiya, Hirakata; Yoshiyuki Miyoshi, Moriguchi; Kanji Machida, Hirakata, all of Japan

[73] Assignee: Matsushita Electric Industrial Co., Ltd., Kadoma, Japan

[21] Appl. No.: 190,852

[22] PCT Filed: Jun. 29, 1979

[86] PCT No.: PCT/JP79/00168

§ 371 Date: Mar. 7, 1980

§ 102(e) Date: Mar. 6, 1980

[87] PCT Pub. No.: WO80/00196

PCT Pub. Date: Feb. 7, 1980

[30] Foreign Application Priority Data

Jul. 7, 1978 [JP] Japan ..... 53/83371

[51] Int. Cl.[3] ..... H01F 3/02

[52] U.S. Cl. ..... 156/215; 29/609; 156/222; 156/22; 156/272.4; 264/259; 264/295; 264/DIG.58; 335/302

[58] Field of Search ..... 335/302, 303; 29/609; 264/108, 295, 259, 296, DIG. 58, 22; 156/215, 219, 222, 187, 196, 220, 272

[56] References Cited

U.S. PATENT DOCUMENTS

| | | | |
|---|---|---|---|
| 3,127,461 | 3/1964 | Blume, Jr. | 264/325 |
| 3,359,152 | 12/1967 | Blume | 335/302 |
| 3,837,959 | 9/1974 | Bishop | 264/295 |
| 3,903,228 | 9/1975 | Riedl et al. | 264/108 |
| 4,057,606 | 11/1977 | Kobayashi et al. | 264/DIG. 58 |
| 4,185,262 | 1/1980 | Watanabe et al. | 335/302 |

*Primary Examiner*—Jerome W. Massie

*Attorney, Agent, or Firm*—Stevens, Davis, Miller & Mosher

[57] ABSTRACT

A process for producing roll-shaped magnets which may be used in electrophotographic copying machines or the like. At least two types of composite magnet sheets of different magnetic characteristics, each having a magnetic orientation in the thickness direction, are superposed to form a laminated body. A plurality of wedge-shaped indentations are formed in one side of the laminated body. The laminated body is then wound around a shaft so that its surface having the indentations constitutes the inner peripheral surface. A magnetization is then effected. This process conveniently permits the full magnetization of the laminated body to ensure a high quality and superior characteristic of the products, as well as a high productivity. during the mass production of such magnets.

8 Claims, 9 Drawing Figures

PROCESS OF PRODUCING ROLL-SHAPED MAGNET

TECHNICAL FIELD

The present invention relates to a process of producing a roll-shaped magnet which is used, for example, in an electrophotographic copying machine.

BACKGROUND ART

Generally, the roll-shaped magnet is fitted in a cylindrical sleeve to cooperate with the latter in transferring toner. There are two types of roll-shaped magnets: a symmetrically magnetized type and an asymmetrically magnetized type.

When the roll-shaped magnet of the symmetrically magnetized type is used, the roll-shaped magnet is rotated in the sleeve so that the toner is transferred along the outer peripheral surface of the sleeve, while, when the roll-shaped magnet is the asymmetrically magnetized type, the sleeve is rotated to transfer the toner.

FIG. 1 shows a typical example of a conventional roll-shaped magnet. This roll-shaped magnet has a shaft 1 and an isotropic ferrite magnet 2 sintered and shaped into a pipe-like form. The isotropic ferrite magnet 2 is bonded to the outer peripheral surface of the shaft 1. The roll-shaped magnet is magnetized through a magnetizing yoke which is adjusted to provide the desired magnetic force for each pole by varying factors such as the shape of the magnetizing yoke, the magnetizing current, the number of turns of the magnetizing winding and so forth.

The roll-shaped magnet produced by the above-stated magnetizing method exhibits a stable magnetic characteristic without a fluctuation of the rate of magnetization, if it is magnetized fully, i.e. to the level of the magnetic saturation. However, the magnetic characteristic is inconveniently rendered unstable when the magnetization is at a level below the magnetic saturation. This poses a problem in the manufacture of the asymmetrically magnetized roll-shaped magnet or roll-shaped magnets having different degrees of magnetization with the same magnetic material, although no problem is created in the manufacture of roll-shaped magnets having a full magnetization of the symmetrical type. In the manufacture of a roll-shaped magnet of the asymmetrically magnetized type, or the roll-shaped magnets having different degrees of magnetization with the same magnetic material, it is often necessary to magnetize the magnetic material to an unsaturated level. In such a case, the degree of magnetization is largely varied by fluctuations of magnetizing factors such as level of the magnetizing current, number of turns of the magnetizing winding and so forth so as to make it difficult to control the desired fluctuation of the magnetic force.

It should also be pointed out that the blank of the roll-shaped magnet exhibits a large deflection due to a contraction caused by the sintering. More specifically, the deflection becomes greater as the axial length of the blank becomes greater and as the diameter of the same becomes smaller. This limits in the practical size of the roll-shaped magnet since a deflection of the magnet blank causes a deformation of the central bore, which in turn deteriorates the tightness of the fit between the shaft 1 and the magnet 2, resulting in a reduced bonding strength. In addition, the magnetic flux density is as small as 1100 to 1150 gauss even at the full magnetization while the magnet has a comparatively large specific gravity of about 1.5 and can easily be broken by an impact.

FIGS. 2 and 3 show another example of conventional roll-shaped magnets in which anisotropic plate-shaped sintered magnets 4 are bonded to the desired pole positions on the surface of the shaft 3. The distances a and b between the center of the shaft 3 and the surfaces of the plate-shaped sintered magnets 4 are suitably adjusted to provide a desired magnetic force distribution.

This type of roll-shaped magnet poses the following problems. The use of anisotropic plate-shaped sintered magnets 4 uneconomically raises the material cost and requires a large number of steps in the manufacturing process. In order to obtain a uniform magnetic force distribution in the axial direction, it is necessary to provide a precise degree of flatness to the surfaces of the plate-shaped magnets, which in turn requires high precision processing such as machining and bonding of the plate-shaped magnets 4. Thus, this type of the roll-shaped magnet is not suitable for mass-production. For producing an axially long roll-shaped magnet of this type, it is necessary to connect a plurality of segments of each plate-shaped sintered magnet in the axial direction to obtain the desired length. As a result, a non-linearity or local reduction of the magnetic force is observed at each seam G of the plate-shaped sintered magnets 4.

DISCLOSURE OF THE INVENTION

The present invention offers a novel process of manufacturing a roll-shaped magnet, comprising the steps of preparing at least two composite magnet sheets of different magnetic characteristics, each composite magnet sheet in which magnetically anisotropic ferrite particles are magnetically orientated in the rolling direction; superposing the composite magnet sheets to form a laminated body; forming wedge-shaped indentations in one side of the laminated body and winding the laminated body around a shaft such that the side having the indentations constitutes the inner peripheral surface of the wound laminated body; whereby a plurality of axes of easy magnetization are arranged substantially radially with the magnetizing pole as the center thereof. It is remarkable that this process facilitates an easy adjustment of the degree of magnetization to ensure a stable characteristic and a high quality of the roll-shaped magnet.

THE BEST MODE OF THE INVENTION

Figure 1:
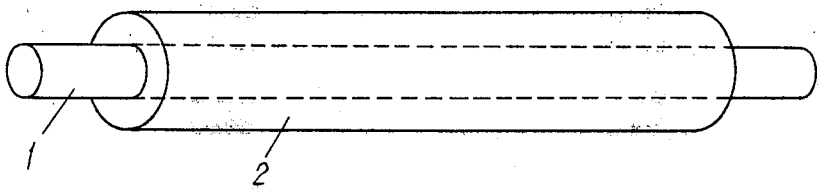
FIG. 1 is a perspective view of an example of the conventional roll-shaped magnets.
Figure 2:
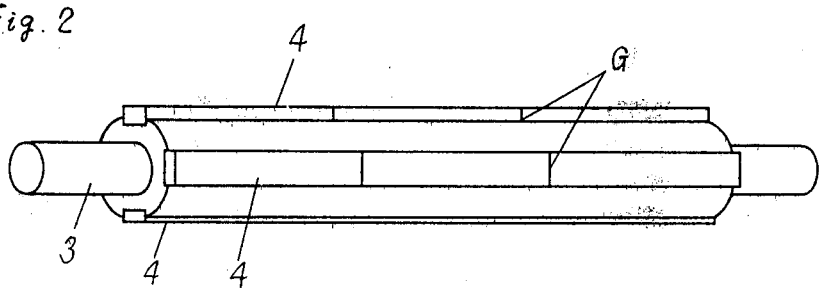
FIG. 2 is a perspective view of another example of the conventional roll-shaped magnets.
Figure 3:
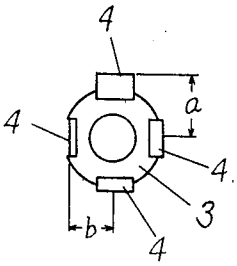
FIG. 3 is a side elevational view of the roll-shaped magnet shown in FIG. 2.
Figure 4:
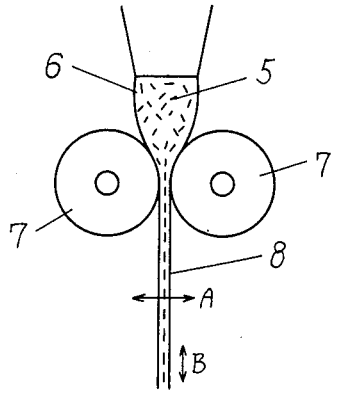
FIG. 4 is a schematic illustration of a process step for manufacturing a magnetic sheet in accordance with the invention for manufacturing a roll-shaped magnet.
Figure 5:
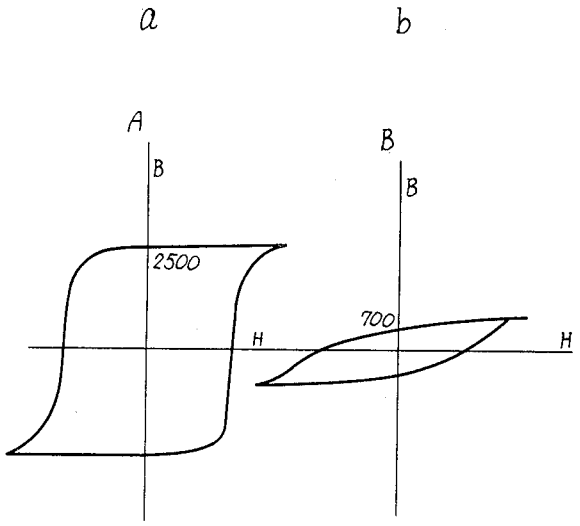
FIG. 5 shows the magnetic characteristics in the thickness (a) and width (b) directions of the magnet sheet.

Referring to FIG. 4, a mixture is formed of scalelike ferrite particles 5, which have undergone a magnetic anisotropic treatment, and a medium 6, such as rubber or a synthetic resin, which serves as a bonding agent for bonding the ferrite particles 5. The mixture is formed into a magnet sheet 8 as it passes between a pair of rotating rolls 7,7. In this composite magnet sheet 8, the ferrite particles are orientated in the direction of rolling, so that the composite magnet sheet 8 has such a magnetic characteristic that the ferromagnetism is exhibited much more in the thickness direction A than in the longitudinal direction B of the magnet sheet 8.

As a practical example of the above-mentioned mixture, it is possible to use a mixture of 6 wt % of chlorinated polyethylene, 5.9 wt % of plasticizer, 0.1 wt % of lubricant and 88 wt % of ferrite powders containing at least one element from the group of barium, strontium and lead. It is noted here that the component ratio is only one example and is not exclusive.

A composite magnet sheet having a thickness in the range between 0.5 mm and 3.0 mm is suitable to obtain a uniform magnetic orientation. However, the magnetic orientation is made irregular as the thickness of the composite magnet sheet exceeds 3.0 mm.

More than two compound magnetic sheets of different magnetic characteristics are formed in the manner stated above. The different magnetic characteristics can easily be obtained by changing the compound ratio of the ferrite powder or by adding different magnetic powders such as rare earth elements.

The compound magnet sheets thus formed are superposed to form a laminated plate-shaped body of a desired thickness. The laminated plate-shaped body can have various constructions. For instance, a composite magnet sheet having a different magnetic characteristic may constitute the outermost layer, an intermediate layer or the innermost layer when the laminated plate-shaped body is wound to form a cylinder as will be explained later. It is also possible to form an arrangement wherein some parts of the outermost layer are constituted by a composite magnet sheet while the other parts are constituted by another composite magnet sheet having a different magnetic characteristic.

Figure 6:
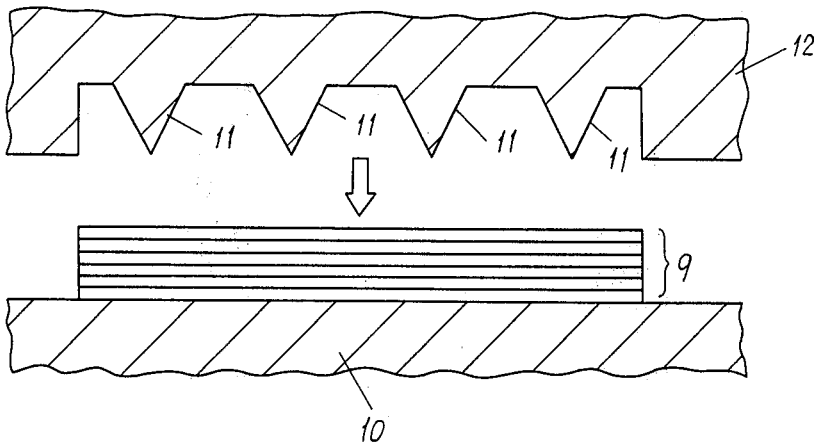
FIG. 6 is an illustration of a step of forming notches in the laminated body of the magnetic sheets, showing the laminated body in a front elevation.
Figure 7:
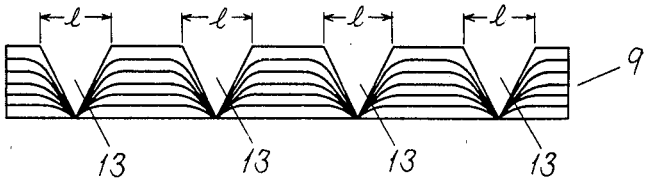
FIG. 7 is a front elevational view of the laminated body of the magnet sheet after the formation of the notches in the step 6.

The laminated plate shaped body 9 thus formed is placed on a lower die 10 having a flat surface as illustrated in FIG. 6. Then, an upper die 12 having a plurality of wedge-shaped projections 11 arranged at a constant pitch is pressed against the laminated plate-shaped body to form a plurality of wedge-shaped indentations 13 only in one side of the latter as shown in FIG. 7. The number and positions of the indentations are so selected as to allow suitable magnetic poles to be provided for the roll-shaped magnet to be produced. The width l of opening of the wedge-shaped indentation 13 is determined to be equal to the quotient obtained through dividing the difference between the inner and outer circumferential lengths of the roll-shaped magnet by the number of the indentations 13. By so doing, it is possible to easily bend the laminated plate-shaped body into the shape of a roll, because the wedge-shaped indentations permit an easy bending without causing any compression in the radially inner part of the roll-shaped magnet.

Figure 8:
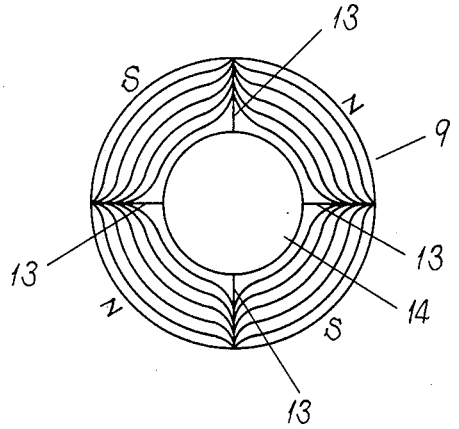
FIG. 8 is a side elevational view of a roll-shaped magnet as manufactured by the process in accordance with the invention.
Figure 9:
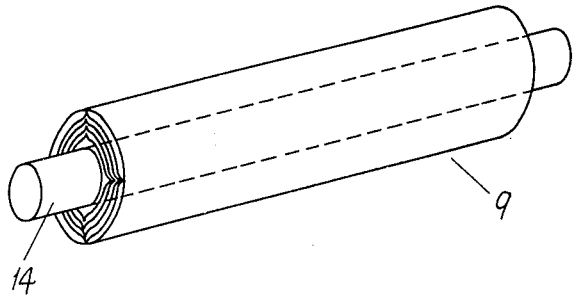
FIG. 9 is a perspective view of the roll-shaped magnet shown in FIG. 8.

The laminated plate-shaped body 9 having wedge-shaped indentations 13 in its one side is then wound around a shaft 14 in a manner shown in FIGS. 8 and 9. Then, a magnetization is effected on the portions of the laminated body 9 between adjacent indentations 13 so as to complete the roll-shaped magnet.

Assuming that the composite magnet sheet constituting the outermost layer has a small value of BHmax, the roll-shaped magnet as a whole exhibits the smallest magnetic flux density. The magnetic flux density on the surface of the roll-shaped magnet sheet, however, is gradually increased as the position of the composite magnet sheet having the small value of BHmax is shifted radially inward. The increase of the magnetic flux density, however, is saturated as the depth of this composite magnet sheet from the surface of the roll-shaped magnet reaches 5 mm, and not further increase of magnetic flux density can be obtained even if the position of this composite magnet sheet is moved radially inward beyond this position. Thus, no substantial different effect over that obtained with a single magnet sheet is produced if the composite magnet sheet is positioned at a depth greater than 5 mm from the surface of the roll-shaped magnet.

The values of BHmax of the composite magnet sheets of different magnetic characteristics, as well as the positions or depths of these composite magnet sheets from the surface of the roll-shaped magnet, are suitably selected to achieve a fine and exquisite control of the magnetic flux density on the surface of the roll-shaped magnet. In addition, it is quite advantageous that each composite magnet sheet can be magnetized fully, i.e. to the level of magnetic saturation.

For obtaining an uneven or different distribution of the magnetic flux density in each magnetic pole of the roll-shaped magnet, each magnetic roll may be composed of a plurality of sections constituted by composite magnet sheets of different magnetic characteristics.

APPLICABILITY TO INDUSTRIAL USES

As has been described, the process of the invention for producing roll-shaped magnets offers various advantages. First, the method of the invention permits the production of roll shaped magnets at a high precision of dimensions, i.e. without substantial fluctuation of size. Second, the process is comparatively simple and is suited for mass production of the roll-shaped magnets. Breakage of the blanks during manufacturing is greatly reduced to ensure a high yield of the product. The fine or exquisite adjustment of the magnetic flux density on the surface of the roll-shaped magnet is made possible by using, in combination, a plurality of composite magnetic sheets having different magnetic characteristics. Since each composite magnet sheet can be magnetized fully, i.e. to the level of magnetic saturation, the undesireable fluctuation of the physical characteristics can be avoided and a higher quality of the product can be obtained by a finishing process which is comparatively easy to perform. In addition, the roll-shaped magnet produced by the method of the invention can have a specific gravity which is as small as 3.5.

Further, since the axes of easy magnetization are arranged substantially radially with the magnetizing pole as the center thereof, it is possible to obtain a large magnetic flux density on the surface of the roll-shaped magnet, which in turn makes it possible to reduce the size of the roll-shaped magnet.

Thus, the process of the invention for roll-shaped magnet offers various industrial advantages.

We claim:

1. A process of producing a roll-shaped magnet, comprising the steps of:

(a) forming at least two magnetic sheets having magnetic characteristics different from each other, each sheet being formed by mixing a plurality of magnetic particles, which have undergone a magnetic anisotropic treatment, with a medium for binding said magnetic particles so as to form a mixture, and then rolling said mixture to form a sheet wherein said magnetic particles are oriented in the direction of rolling;

(b) laminating the magnetic sheets together so as to form a laminating body;

(c) forming a plurality of wedge-shaped indentations in one surface of said laminated body;

(d) winding the laminated body around a shaft, the surface with indentations contacting said shaft so as to form the inner peripheral surface, each successive layer having indentations which are aligned so as to form a plurality of substantially radial axes, the shaft being a magnetizing pole; and (e) magnetizing the laminated body.

2. A process of producing a roll-shaped magnet as recited in claim 1, wherein each of said wedge-shaped indentations formed in one surface of said laminated body has an opening having a width which is equal to a quotient obtained by dividing the difference of the outer circumferential length and the inner circumferential length of the laminated body wound around the shaft, by the number of said wedge-shaped indentations.

3. A process of producing a roll-shaped magnet as recited in claim 1, wherein the thickness of said laminated body is less than 5 mm.

4. A process of producing a roll-shaped magnet as recited in claim 1, wherein said laminated body has at least one surface which is comprised of at least two magnetic sheets having magnetic characteristics different from each other.

5. A process of producing a roll-shaped magnet as recited in claim 1, wherein said laminated body has at least one surface which is consisted solely of a magnetic sheet.

6. A process of producing a roll-shaped magnet as recited in claim 1, wherein each magnetic sheet is magnetized to a level of magnetic saturation.

7. A process of producing a roll-shaped magnet as recited in claim 1, wherein said roll-shaped magnet has a specific gravity greater than about 3.5.

8. A process of producing a roll-shaped magnet as recited in claim 1, wherein said magnetic sheets have a thickness in the range between about 0.5 mm and about 3.0 mm.

* * * * *